US009858857B2

(12) United States Patent
Kim et al.

(10) Patent No.: US 9,858,857 B2
(45) Date of Patent: Jan. 2, 2018

(54) SIGNAL PROCESSOR AND ORGANIC LIGHT-EMITTING DIODE DISPLAY HAVING REDUCED LUMINANCE DEVIATION INCLUDING THE SAME

(71) Applicant: Samsung Display Co., Ltd., Yongin, Gyeonggi-Do (KR)

(72) Inventors: Seong-Kyun Kim, Seoul (KR); Dong-Hak Pyo, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 281 days.

(21) Appl. No.: 14/696,854

(22) Filed: Apr. 27, 2015

(65) Prior Publication Data

US 2016/0148559 A1 May 26, 2016

(30) Foreign Application Priority Data

Nov. 26, 2014 (KR) ..... 10-2014-0166044

(51) Int. Cl.
*G09G 3/3208* (2016.01)

(52) U.S. Cl.
CPC ... *G09G 3/3208* (2013.01); *G09G 2320/0233* (2013.01); *G09G 2320/0271* (2013.01); *G09G 2320/0276* (2013.01); *G09G 2320/043* (2013.01); *G09G 2320/0673* (2013.01); *G09G 2360/16* (2013.01)

(58) Field of Classification Search
CPC .. G09G 3/3208; G09G 3/3225; G09G 3/3233; G09G 3/3258; G09G 2320/0233; G09G 2320/0271; G09G 2320/0276; G09G 2320/043; G09G 2320/045; G09G 2320/048; G09G 2320/0673; G09G 2360/16
See application file for complete search history.

(56) References Cited

U.S. PATENT DOCUMENTS

2011/0199395 A1* 8/2011 Nathan ..... G09G 3/3241 345/690
2014/0267372 A1* 9/2014 Chaji ..... G06T 3/403 345/606
2015/0154913 A1* 6/2015 Kim ..... G09G 3/3233 345/691

FOREIGN PATENT DOCUMENTS

KR 10-2012-0094736 A 8/2012
KR 10-2013-0002118 A 1/2013
(Continued)

*Primary Examiner* — Keith Crawley
(74) *Attorney, Agent, or Firm* — Knobbe Martens Olson & Bear, LLP

(57) ABSTRACT

A signal processor and an OLED display including the same are disclosed. In one aspect, the display includes a plurality of pixels and a luminance deterioration calculator configured to receive input image data and calculate luminance deterioration values of the pixels. A data compensator is configured to calculate compensation coefficients for each of the pixels based at least in part on the luminance deterioration values, adjust a compensation margin based at least in part on the maximum value of the compensation coefficients, and generate compensation image data for each of the pixels based at least in part on the compensation coefficients and the compensation margin. A panel driver is configured to generate data signals based at least in part on the compensation image data and transmit the data signal to the pixels and a timing controller configured to control the panel driver.

18 Claims, 6 Drawing Sheets

(56) References Cited

FOREIGN PATENT DOCUMENTS

| | | | |
|---|---|---|---|
| KR | 10-2013-0064552 | A | 6/2013 |
| KR | 10-2013-0067092 | A | 6/2013 |

* cited by examiner

SIGNAL PROCESSOR AND ORGANIC LIGHT-EMITTING DIODE DISPLAY HAVING REDUCED LUMINANCE DEVIATION INCLUDING THE SAME

INCORPORATION BY REFERENCE TO ANY PRIORITY APPLICATIONS

This application claims priority under 35 U.S.C. §119 to Korean patent Application No. 10-2014-0166044 filed on Nov. 26, 2014, the disclosure of which is hereby incorporated by reference herein in its entirety.

BACKGROUND

1. Field

The described technology generally relates to a signal processor and an organic light emitting diode display including the signal processor.

2. Description of the Related Technology

An organic light-emitting diode (OLED) display includes a plurality of pixels that display an image based on light emitted by the pixels.

SUMMARY OF CERTAIN INVENTIVE ASPECTS

One inventive aspect is an OLED display that can decrease a luminance deviation of an output light.

Another aspect is a signal processor that can prevent image distortion.

Another aspect is an OLED display that can include a display panel including a plurality of pixels, a luminance deterioration calculating unit configured to calculate luminance deterioration values of the pixels, a data compensation unit configured to calculate compensation coefficients for each of the pixels based on the luminance deterioration values, and configured to adjust a compensation margin based on a maximum value of the compensation coefficients, and configured to generate compensation image data by compensating input image data for each of the pixels based on the compensation coefficient, and the compensation margin, a panel driving unit configured to generate data signals based on the compensation image data, and configured to provide the data signal to the pixels, and a timing control unit configured to control the panel driving unit.

In example embodiments, the luminance deterioration values increases as degrees of deterioration of the pixels increase.

In example embodiments, the data compensation unit includes a compensation coefficient calculating part configured to calculate the compensation coefficients that offset the luminance deterioration values, a maximum coefficient determining part configured to determine a maximum compensation coefficient that is the maximum value of the compensation coefficients, a margin adjusting part configured to adjust the compensation margin based on the maximum compensation coefficient, a gamma setting part configured to determine a first gamma curve such that a difference between a predetermined maximum luminance value of the pixels and a luminance value corresponding to a maximum grayscale level in the first gamma curve is greater than the compensation margin, and configured to determine a second gamma curve by scaling the first gamma curve with the compensation coefficients. Finally the data compensation unit can include a compensation image data generating part configured to generate the compensation image data that corresponds to grayscale levels of the input image data using the second gamma curve.

In example embodiments, the data compensation unit includes a compensation coefficient calculating part configured to calculate the compensation coefficients that offset the luminance deterioration values, a maximum coefficient determining part configured to determine a maximum compensation coefficient that is the maximum value of the compensation coefficients, a margin adjusting part configured to adjust the compensation margin based on the maximum compensation coefficient, a gamma setting part configured to determine a first gamma curve such that a difference between a predetermined maximum luminance value of the pixels and a luminance value corresponding to a maximum grayscale level in the first gamma curve is greater than the compensation margin. Finally the data compensation unit can include compensation image data generating part configured to generate a middle image data corresponding to grayscale levels of the input image data using the first gamma curve, and configured to generate the compensation image data by scaling the middle image data with the compensation coefficients.

In example embodiments, the compensation coefficient calculating part estimates an output luminance of light emitted by the pixels based on the degrees of deterioration.

In example embodiments, the compensation coefficient calculating part estimates the output luminance based on a look up table (LUT).

In example embodiments, the compensation coefficient calculating part calculates the compensation coefficients according to [Equation 1] below:

$$SF1=Lo/L \quad \text{[Equation 1]}$$

wherein, SF1 is a compensation coefficient, Lo is an initial luminance of each pixel, and L is an output luminance of each of the pixel.

In example embodiments, the gamma setting part determines the first gamma curve by scaling a standard gamma curve with a margin coefficient that is generated based on the compensation margin.

In example embodiments, the display device further includes an application processor (AP) including the margin adjusting part.

In example embodiments, the timing control unit includes the compensation coefficient calculating part, the maximum coefficient determining part, and the gamma setting part.

In example embodiments, the pixels includes a sample pixel and a normal pixel, and the luminance deterioration calculating unit calculates a sample luminance deterioration value of the sample pixel, and calculate a normal luminance deterioration value of the normal pixel based on the sample luminance deterioration value to calculate the luminance deterioration values.

In example embodiments, the luminance deterioration calculating unit calculates the normal luminance deterioration value using an interpolation technique for the sample luminance deterioration value.

Another aspect is a signal processor that includes a luminance deterioration calculating unit configured to calculate luminance deterioration values of pixels, and a data compensation unit configured to calculate compensation coefficients for each of the pixels based on the luminance deterioration values, configured to adjust a compensation margin based on a maximum value of the compensation value, and configured to generate compensation image data by compensating input image data for each of the pixels based on the compensation coefficient and the compensation margin.

In example embodiments, the luminance deterioration values increase as a degree of deterioration of the pixels increases.

In example embodiments, the data compensation unit includes a compensation coefficient calculating part configured to calculate the compensation coefficients that offset the luminance deterioration values, a maximum coefficient determining part configured to determine a maximum compensation coefficient that is the maximum value of the compensation coefficients, a margin adjusting part configured to adjust the compensation margin based on the maximum compensation coefficient, a gamma setting part configured to determine a first gamma curve such that a difference between a predetermined maximum luminance value of the pixels and a luminance value corresponding to a maximum grayscale level in the first gamma curve is greater than the compensation margin, and a compensation image data generating part configured to generate a middle image data corresponding grayscale levels of input image data using to the first gamma curve, and configured to generate the compensation image data by scaling the middle image data with the compensation coefficient.

In example embodiments, the compensation coefficient calculating part estimates an output luminance of light emitted by the pixels based on the degrees of deterioration.

In example embodiments, the compensation coefficient calculating part estimates the output luminance based on a look up table (LUT).

In example embodiments, the compensation coefficient calculating part calculates the compensation coefficients according to [Equation 2] below:

$$SF1=Lo/L \quad \text{[Equation 2]}$$

wherein, SF1 is a compensation coefficient, Lo is an initial luminance of each pixel, and L is an output luminance of each pixel.

In example embodiments, the gamma setting part determines the first gamma curve by scaling a standard gamma curve with a margin coefficient that is generated based on the compensation margin.

In example embodiments, the pixels include a sample pixel and a normal pixel. The luminance deterioration calculating unit can calculate a sample luminance deterioration value of the sample pixel and calculate a normal luminance deterioration value of the normal pixel based on the sample luminance deterioration value to calculate the luminance deterioration value.

Another aspect is an organic light-emitting diode (OLED) display comprising a display panel including a plurality of pixels and a luminance deterioration calculator configured to receive input image data and calculate luminance deterioration values of the pixels. The display also includes a data compensator configured to i) calculate compensation coefficients for each of the pixels based at least in part on the luminance deterioration values, ii) adjust a compensation margin based at least in part on the maximum value of the compensation coefficients, and iii) generate compensation image data for each of the pixels based at least in part on the compensation coefficients and the compensation margin. The display also includes a panel driver configured to generate data signals based at least in part on the compensation image data and transmit the data signal to the pixels and a timing controller configured to control the panel driver.

In the above display, the luminance deterioration calculator is further configured to increase the luminance deterioration values as degrees of deterioration of the pixels increase.

In the above display, the pixels have a predetermined maximum luminance value, wherein the data compensator includes: a compensation coefficient calculator configured to calculate the compensation coefficients so as to offset the luminance deterioration values; a maximum coefficient determining portion configured to determine a maximum compensation coefficient including the maximum value of the compensation coefficients; a margin adjuster configured to adjust the compensation margin based at least in part on the maximum compensation coefficient; a gamma setting portion configured to i) determine a first gamma curve such that the difference between the predetermined maximum luminance value and a luminance value corresponding to a maximum grayscale level in the first gamma curve is greater than the compensation margin and ii) scale the first gamma curve based at least in part on the compensation coefficients so as to determine a second gamma curve; and a compensation image data generator configured to generate the compensation image data corresponding to grayscale levels of the input image data based at least in part on the second gamma curve.

In the above display, the pixels have a predetermined maximum luminance value, wherein the data compensation portion includes: a compensation coefficient calculator configured to calculate the compensation coefficients so as to offset the luminance deterioration values; a maximum coefficient determining portion configured to determine a maximum compensation coefficient including the maximum value of the compensation coefficients; a margin adjuster configured to adjust the compensation margin based at least in part on the maximum compensation coefficient; a gamma setting portion configured to determine a first gamma curve such that the difference between the predetermined maximum luminance value and a luminance value corresponding to a maximum grayscale level in the first gamma curve is greater than the compensation margin; and a compensation image data generator configured to i) generate a middle image data corresponding to grayscale levels of the input image data based at least in part on the first gamma curve and ii) scale the middle image data based at least in part on the compensation coefficients so as to generate the compensation image data.

In the above display, the compensation coefficient calculator is further configured to estimate an output luminance of light emitted by the pixels based at least in part on the degrees of deterioration.

In the above display, the compensation coefficient calculator is further configured to estimate the output luminance based at least in part on a look up table (LUT).

In the above display, the compensation coefficient calculator is further configured to calculate the compensation coefficients according to Equation 1:

$$SF1=Lo/L$$

wherein SF1 is a compensation coefficient, Lo is an initial luminance value of each pixel, and L is an output luminance value of each pixel.

In the above display, the gamma setting portion is further configured to i) generate a margin coefficient based at least in part on the compensation margin and ii) scale a standard gamma curve based at least in part the margin coefficient.

The above display further comprises an application processor (AP) including the margin adjuster.

In the above display, the timing controller includes the compensation coefficient calculator, the maximum coefficient determining portion, and the gamma setting portion.

In the above display, the pixels include a sample pixel and a normal pixel and the luminance deterioration calculator is further configured to i) calculate a sample luminance deterioration value of the sample pixel, ii) calculate a normal luminance deterioration value of the normal pixel based at least in part on the sample luminance deterioration value, and iii) calculate the luminance deterioration values based at least in part on the sample and normal luminance deterioration values.

In the above display, the luminance deterioration is further configured to interpolate the sample luminance deterioration value so as to calculate the normal luminance deterioration value.

Another aspect is a signal processor for an organic light-emitting diode (OLED) display including a plurality of pixels, comprising: a luminance deterioration calculator configured to calculate luminance deterioration values of the pixels, wherein the OLED display is configured to receive input image data; and a data compensator configured to i) calculate compensation coefficients for each of the pixels based at least in part on the luminance deterioration values, ii) adjust a compensation margin based at least in part on the maximum value of the compensation value, and iii) generate compensation image data for each of the pixels based at least in part on the compensation coefficients and the compensation margin.

In the above signal processor, the luminance deterioration calculator is further configured to increase the luminance deterioration values as degrees of deterioration of the pixels increase.

In the above signal processor, the pixels have a predetermined maximum luminance value, wherein the data compensator includes: a compensation coefficient calculator configured to calculate the compensation coefficients so as to offset the luminance deterioration values; a maximum coefficient determining portion configured to determine a maximum compensation coefficient including the maximum value of the compensation coefficients; a margin adjuster configured to adjust the compensation margin based at least in part on the maximum compensation coefficient; a gamma setting portion configured to i) determine a first gamma curve such that the difference between the predetermined maximum luminance value and a luminance value corresponding to a maximum grayscale level in the first gamma curve is greater than the compensation margin; and a compensation image data generator configured to i) generate a middle image data corresponding to grayscale levels of the input image data based at least in part on the first gamma curve and ii) scale the middle image data with the compensation coefficient so as to generate the compensation image data.

In the above signal processor, the compensation coefficient calculator is further configured to estimate an output luminance of light emitted by the pixels based at least in part on the degrees of deterioration.

In the above signal processor, the compensation coefficient calculator is further configured to estimate the output luminance based at least in part on a look up table (LUT).

In the above signal processor, the compensation coefficient calculator is further configured to calculate the compensation coefficients according to Equation:

$$SF1=Lo/L$$

wherein, SF1 is a compensation coefficients, Lo is an initial luminance value of each pixel, and L is an output luminance value of each pixel.

In the above signal processor, the gamma setting portion is further configured to i) generate a margin coefficient based at least in part on the compensation margin and ii) scale a standard gamma curve based at least in part on the margin coefficient.

In the above signal processor, the pixels include a sample pixel and a normal pixel, wherein the luminance deterioration calculator is further configured to i) calculate a sample luminance deterioration value of the sample pixel, ii) calculate a normal luminance deterioration value of the normal pixel based at least in part on the sample luminance deterioration value, and iii) calculate the luminance deterioration value based at least in part on the sample and normal luminance deterioration values.

According to at least one of the disclosed embodiments, an OLED display reduces a luminance deviation of an output light by compensating input image data based on compensation coefficients In addition, a signal processor according to example embodiments can adjust a compensation margin based on a maximum value of the compensation coefficients, thereby preventing an image distortion that occurs by a predetermined maximum luminance.

DETAILED DESCRIPTION OF CERTAIN INVENTIVE EMBODIMENTS

Pixels degrade as a function of driving time, and luminance will naturally decrease as the pixels degrade. Particularly in OLED displays, the OLED in each pixel is relatively sensitive to degradation, and thus, the display will have a relatively large amount of luminance loss. And since pixels have different rates of degradation, luminance of the emitted light can be non-uniform, thus, emphasizing the loss of emitted light.

Pixels emit light based on data signals. Therefore, the OLED display can compensate input image data to reduce the effect of luminance degradation. An ideal OLED display increases the luminance in proportion to the degree of degradation. However, a typical OLED display does not increase the luminance of the light more than a predetermined maximum luminance amount. Therefore, when the degree of deterioration of the pixel is greater than this predetermined amount, the luminance degradation cannot be further reduced, resulting in image distortion.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
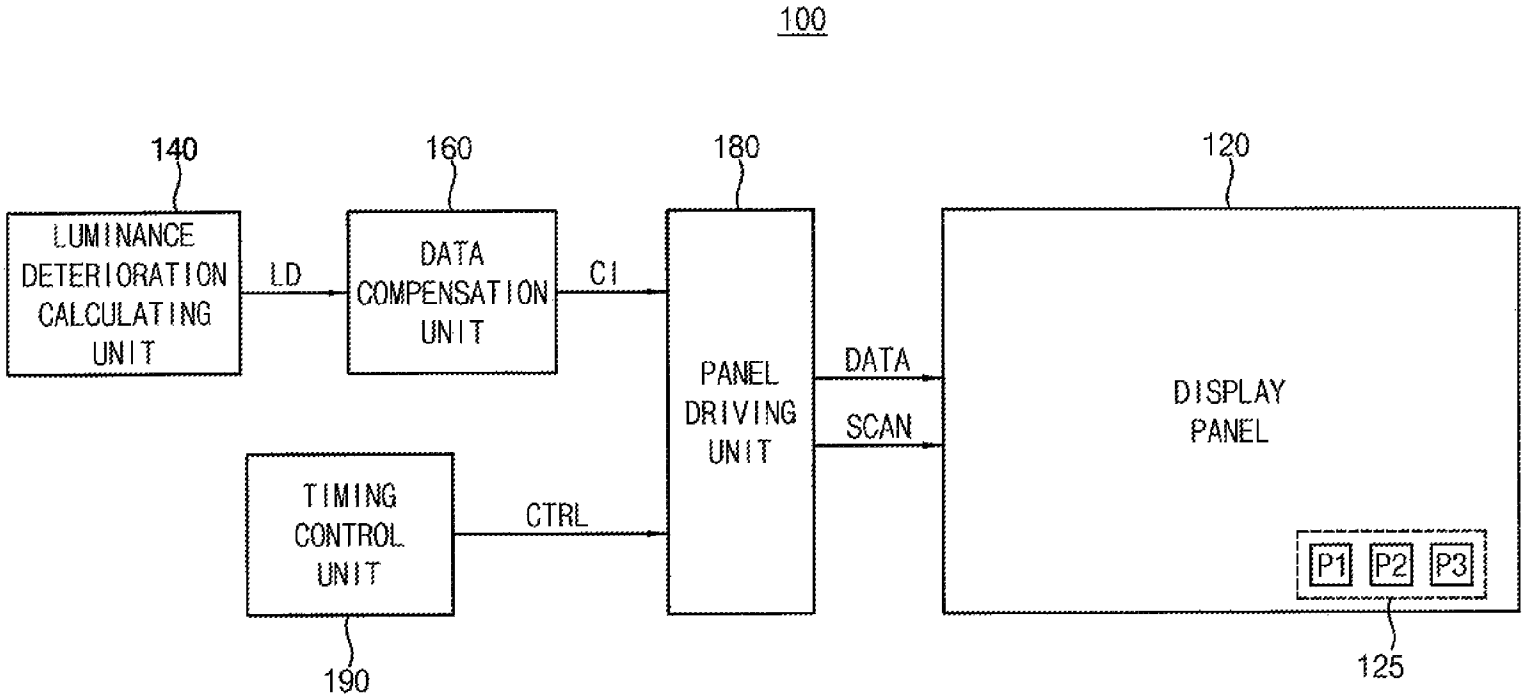
FIG. 1 is a block diagram illustrating an OLED display according to example embodiments.

FIG. 1 is a block diagram illustrating an OLED display according to example embodiments.

Referring to FIG. 1, an OLED display 100 includes a display panel 120, a luminance deterioration calculating unit or luminance deterioration calculator 140, a data compensation unit or data compensator 160, a panel driving unit or panel driver 180, and a timing control unit or timing controller 190.

The display panel 120 includes a plurality of pixels 125. The pixels 125 can emit light based on a data signal DATA. The pixels 125 can include the OLEDs and driving transistors. Each driving transistor can generate a driving current based on the data signal DATA. Each of the OLEDs can emit light based on the driving current. In example embodiments, the pixels 125 include a sample pixel and a normal pixel.

The luminance deterioration calculating unit 140 can calculate luminance deterioration values LD of the pixels 125. The luminance deterioration values LD can occur during a manufacturing process of the pixels 125. In example embodiments, the luminance deterioration value LD increases as a degree of deterioration of the pixel 125 increases.

In example embodiments, the luminance deterioration calculating unit 140 calculates a sample luminance of a sample pixel. Also, the luminance deterioration calculating unit 140 can calculate the luminance deterioration values LD by calculating a normal luminance deterioration value of the normal pixel based on the sample luminance deterioration value. In example embodiments, the luminance deterioration calculating unit 140 calculates the normal luminance deterioration value using interpolation for the sample luminance deterioration value. For example, a first normal pixel has a first degree of deterioration between a second degree of deterioration of a first sample pixel and a second degree of deterioration of a second sample pixel. The first normal pixel can have a luminance deterioration value between a first sample luminance deterioration value of the first sample pixel and a second sample luminance deterioration value of the second sample pixel. In some embodiments, a luminance deterioration calculating unit 140 calculates a normal luminance deterioration value based on a linear interpolation algorithm. In other embodiment, a luminance deterioration calculating unit 140 calculates a normal luminance deterioration value based on a nonlinear interpolation algorithm.

The data compensation unit 160 can calculate compensation coefficients for each of the pixels 125 based on the luminance deterioration values LD. Also, the data compensation unit 160 can adjust a compensation margin based on a maximum value of the compensation coefficients.

The data compensation unit 160 can generate compensation image data by compensating input image data for each of the pixels based on the compensation coefficient and the compensation margin. For example, the data compensation unit 160 compensates input image data by multiplying the compensation coefficient and the middle image data. The compensation coefficients can increase as the luminance deterioration values LD increase. In example embodiments, the luminance deterioration values LD increases as the degrees of deterioration of the pixels 125 increase. Therefore, the compensation coefficients can increase as the degrees of deterioration of the pixels 125 increase.

Figure 2:
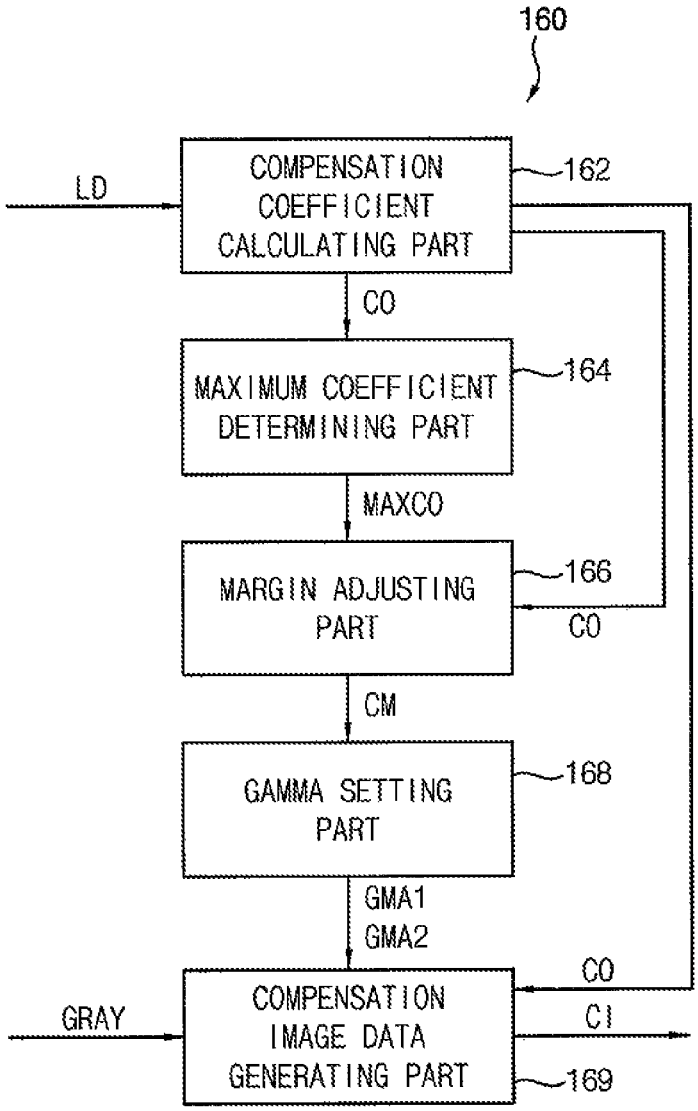
FIG. 2 is a block diagram illustrating an example of a data compensation unit included in an OLED display of FIG. 1.

In example embodiments, the data compensation unit 160 includes a compensation coefficient calculating part or a compensation coefficient calculator 162, a maximum coefficient determining part or maximum coefficient determining portion 164, a margin adjusting part or margin adjuster 166, a gamma setting part or gamma setting portion 168 and a compensation image data generating part or compensation image data generator 169 (see FIG. 2).

The compensation coefficient calculating part can calculate the compensation coefficients that offset the luminance deterioration values LD. In example embodiments, the compensation coefficient calculating part estimates output luminance of light emitted by the pixels 125 based on the degrees of deterioration. For example, a first pixel P1 has a first degree of deterioration, a second pixel P2 has a second degree of deterioration, and a third pixel P3 has a third degree of deterioration. The compensation coefficient calculating part can estimate output luminance for the first pixel P1 based on the first degree of deterioration. The compensation coefficient calculating part can estimate output luminance for the second pixel P2 based on the second degree and estimate output luminance for the third pixel P3 based on the third degree.

In example embodiments, the compensation coefficient calculating part estimates the output luminance based on a look up table (LUT). The luminance that is changed based on the degree of deterioration can be estimated by a simulation. The LUT can be generated using the estimated luminance. The compensation coefficient calculating part can estimate the output luminance based on the LUT that is generated using the estimated luminance. In example embodiments, the compensation coefficient calculating part calculates the compensation coefficients using a following [Equation 1]. The luminance of the light emitted by pixels 125 can be compensated as an initial luminance using the calculated compensation coefficients.

$$SF1=Lo/L \qquad \text{[Equation 1]}$$

where SF1 is a compensation coefficient, Lo is an initial luminance of each pixel, and L is an output luminance of each pixel.

The maximum coefficient determining part can determine a maximum compensation coefficient that is a maximum value of the compensation coefficients. The margin adjusting part can adjust the compensation margin based on the maximum compensation coefficient.

In some embodiments, a gamma setting part determine a first gamma curve such that the difference between a predetermined maximum luminance value of the pixels and a luminance value corresponding to a maximum grayscale level in the first gamma curve is greater than the compensation margin. Also, the gamma setting part can determine a second gamma curve by scaling the first gamma curve with the compensation coefficients. The number of the second gamma curves can be substantially equal to the number of the pixels 125. For example, the gamma setting part determines the second gamma curves by scaling the first gamma curve with the compensation coefficients corresponding to the pixels 125. The compensation image data generating part can generate the compensation image data that corresponds to grayscale levels of the input image data using the second gamma curve.

In some embodiments, the gamma setting part determines a first gamma curve such that the difference between the predetermined maximum luminance value and the luminance value corresponding to the maximum grayscale level in the first gamma curve is greater than the compensation margin. The compensation image data generating part can generate the middle image data corresponding to grayscale levels of the input image data using the first gamma curve. Also, the compensation image data generating part can generate the compensation image data CI by scaling the middle image data with the compensation coefficients.

In some embodiments, the gamma setting part determines the first gamma curve by scaling a standard gamma curve with a margin coefficient based on the compensation margin. Generally, the standard gamma setting is a relationship between the luminance and the grayscale level of the input image data of which gamma value is about 2.2. The standard gamma curve can be determined to emit the light having luminance corresponding to the standard gamma setting. Here, a gamma curve is a relationship between the middle image data and the grayscale levels. The gamma setting part can determine the first gamma curve by scaling the standard gamma curve with the margin coefficient. That is, the gamma setting part can determine a first gamma curve such that the difference between the predetermined maximum luminance value and a luminance value corresponding to a maximum grayscale level in the first gamma curve is greater than the compensation margin. For example, the margin coefficient is less than 1. The first gamma curve can secure the compensation margin by scaling the standard gamma curve with the margin coefficient. Finally, the compensation image data generating part can generate the middle image data corresponding to grayscale levels of the input image data using the first gamma curve.

The panel driving unit 180 can generate data signals DATA based on the compensation image data CI. The panel driving unit 180 can provide the data signals DATA to the pixels 125. The panel driving unit 180 can provide scan signals SCAN to the pixels 125. The pixel 125 can receive the data signal DATA when the scan signal SCAN is activated.

The timing control unit 190 can control the panel driving unit 180. For example, the timing control unit 190 generates a control signal CTRL. The timing control unit 190 can provide the control signal CTRL to the panel driving unit 180.

In example embodiments, the OLED display 100 further includes an application processor (AP). In this case, the AP can include a margin control unit. In example embodiments, the timing control unit 190 includes the compensation coefficient calculating part 162, the maximum coefficient determining unit 164 and the gamma setting part 168.

Therefore, the data compensation unit 160 can compensate the input image data based on the compensation coefficients. Therefore, luminance deviation of an output light can be reduced.

FIG. 2 is a block diagram illustrating an example of the data compensation unit 160 included in an OLED display of FIG. 1.

Referring to FIG. 2, a data compensation unit 160 includes the compensation coefficient calculating part 162, the maximum coefficient determining unit 164, the margin adjusting part 166, the gamma setting part 168, and the compensation image data generating part 169.

The compensation coefficient calculating part 162 can calculate the compensation coefficients CO that offset luminance deterioration values LD. In example embodiments, the compensation coefficient calculating part 162 estimates the output luminance of light emitted by the pixels based on the degrees of deterioration. In example embodiments, the compensation coefficient calculating part 162 estimates the output luminance based on a LUT. The luminance that is changed based on the degree of deterioration can estimate using simulation(s). The LUT can be generated using the estimated luminance. The compensation coefficient calculating part 162 can estimate the output luminance based on the LUT that is generated using the estimated luminance. In example embodiments, the compensation coefficient calculating part 162 calculates the compensation coefficients CO by using the above [Equation 1]. The luminance of the light emitted by pixels can be compensated as an initial luminance using the calculated compensation coefficients.

The maximum coefficient determining part 164 can determine a maximum compensation coefficient MAXCO that is a maximum value of the compensation coefficients. The margin adjusting part 166 can adjust the compensation margin CM based on the maximum compensation coefficient MAXCO.

In some embodiments, the gamma setting part 168 determines a first gamma curve GMA1 such that the difference between the predetermined maximum luminance value and the luminance value corresponding to the maximum grayscale level in the first gamma curve is greater than the compensation margin CM. Also, the gamma setting part 168 can determine a second gamma curve GMA2 by scaling the first gamma curve GMA1 with the compensation coefficients CO. The number of the second gamma curves GMA2 can be substantially equal to the number of the pixels. For example, the gamma setting part 168 determines the second gamma curves GMA2 by scaling the first gamma curve GMA1 with the compensation coefficients CO corresponding to the pixels. The compensation image data generating part 169 can generate the compensation image data CI that corresponds to grayscale levels GRAY of the input image data using the second gamma curve GMA2.

In some embodiments, the gamma setting part 168 determines the first gamma curve GMA1 such that the difference between the predetermined maximum luminance value and the luminance value corresponding to the maximum grayscale level in the first gamma curve is greater than the compensation margin CM. The compensation image data generating part 169 can generate the middle image data corresponding to grayscale levels GRAY of the input image data by using the first gamma curve GMA1. Also, the compensation image data generating part 169 can generate the compensation image data CI by scaling the middle image data with the compensation coefficients CO.

In example embodiments, the gamma setting part 168 determines the first gamma curve GMA1 by scaling a standard gamma curve with a margin coefficient that is generated based on the compensation margin CM. Generally, the standard gamma setting is a relationship between the luminance and the grayscale level GRAY of the input image data of which gamma value is 2.2. The standard gamma curve can be determined to emit the light having luminance corresponding to the standard gamma setting. Here, a gamma curve is a relationship between the middle image data and the grayscale levels GRAY. The gamma setting part 168 can determine the first gamma curve GMA1 by scaling the standard gamma curve with the margin coefficient to secure the compensation margin CM. For example, the margin coefficient is less than 1. The first gamma curve GMA1 can secure the compensation margin by scaling the standard gamma curve with the margin coefficient. Finally, the compensation image data generating part 169 can generate the middle image data corresponding to grayscale levels GRAY of the input image data using the first gamma curve.

Figure 3:
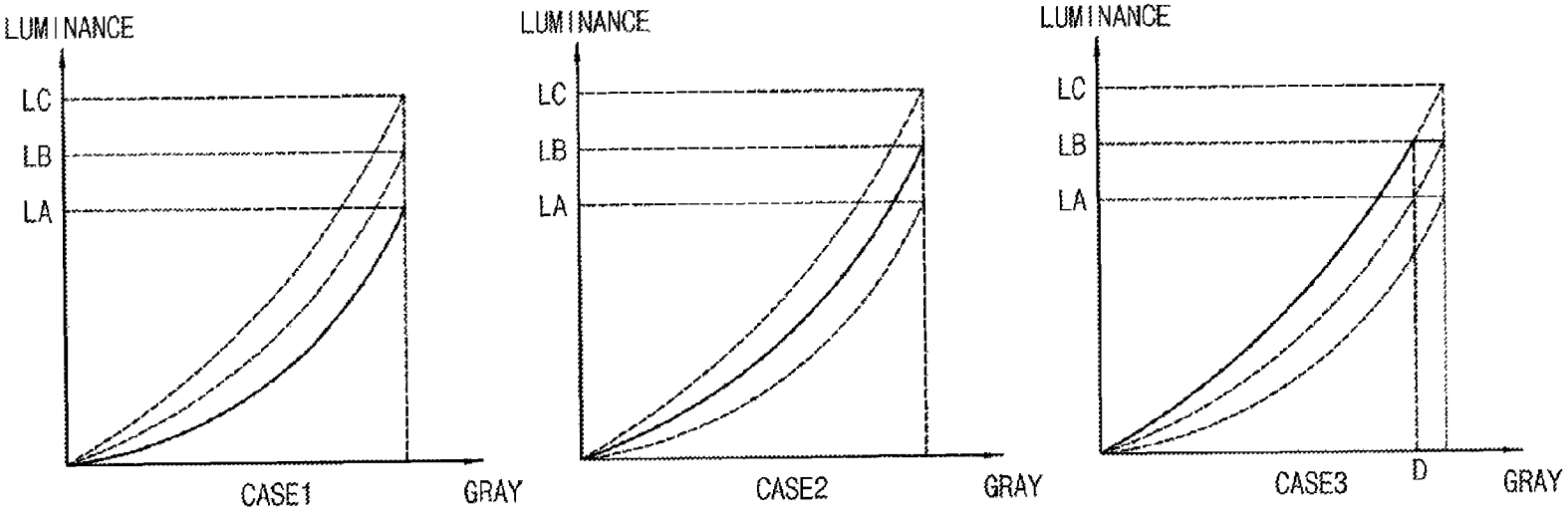
FIG. 3 is a graph for describing an image distortion occurred due to a predetermined maximum luminance value.

FIG. 3 is a graph for describing an image distortion occurred due to the predetermined maximum luminance value.

Referring to FIG. 3, in CASE1, pixels emit light based on a first gamma curve that is not compensated. When input image data has the maximum grayscale level, compensation image data can have a value corresponding to the maximum grayscale level using the first gamma curve. The pixels can emit the light having a first luminance LA corresponding to the maximum grayscale level using the first gamma curve.

In CASE2, the pixels emit light based on a second gamma curve that is compensated such that the maximum grayscale level corresponds to a predetermined maximum luminance (i.e., a second luminance LB). When the input image data has the maximum grayscale level, the compensation image data can have a value corresponding to a maximum grayscale level using the second gamma curve. The pixels can emit the light having the second luminance LB corresponding to the maximum grayscale level using the second gamma curve. Here, a compensation margin can be the difference between the first luminance LA and the second luminance LB (i.e., LB-LA).

In CASE3, the pixels can emit light based on a third gamma curve that is compensated such that the maximum grayscale level corresponds to a third luminance LC greater than the predetermined maximum luminance. When the input image data has the maximum grayscale level, the compensation image data can have a value corresponding to the maximum grayscale level using the third gamma curve. The pixels can emit the light having the third luminance LC corresponding to the maximum grayscale level using the third gamma curve. In some embodiments, the luminance of the light emitted by the pixels is not greater than the predetermined maximum luminance (i.e., the second luminance LB). Therefore, grayscale levels greater than a predetermined grayscale level D can correspond to the predetermined maximum luminance (i.e., the second luminance LB), thereby causing an image distortion.

Figure 4:
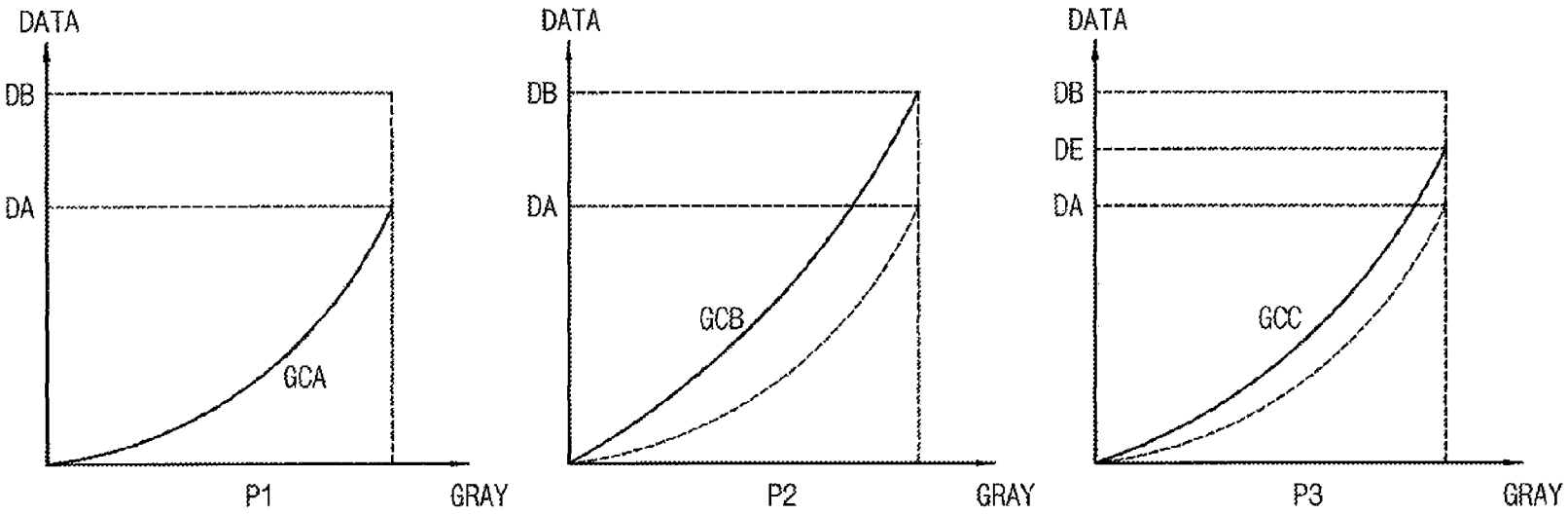
FIG. 4 is a graph for describing examples of generating compensation image data in the OLED display of FIG. 1.

FIG. 4 is a graph for describing examples of generating compensation image data in the OLED display of FIG. 1.

Referring to FIG. 4, compensation image data for the first pixel P1 of FIG. 1 is generated using a first gamma curve GCA that is not compensated. Therefore, when the input image data has a maximum grayscale level, the compensation image data can be set as a first value DA corresponding to the maximum grayscale level using the first gamma curve GCA. When the luminance of the light emitted by the first pixel P1 does not decrease, the compensation image data for the first pixel P1 can be generated using the first gamma curve GCA that is not compensated.

The compensation image data for the second pixel P2 of FIG. 1 can be generated using a second gamma curve GCB that is compensated such that the maximum grayscale level corresponds to a predetermined maximum value (i.e., a second value DB). Therefore, when the input image data has the maximum grayscale level, the compensation image data can be set as the second value DB corresponding to the maximum grayscale level using the second gamma curve GCB. When the luminance of the light emitted by the second pixel P2 decreases more than that of the other pixels (e.g., P1, P3), the compensation image data for the second pixel P2 can be generated using the second gamma curve GCB that is compensated up to the second value DB.

Also, the compensation image data for a third pixel P3 of FIG. 1 can be generated using a third gamma curve GCC that is compensated such that the maximum grayscale level corresponds to a third value DE less than the predetermined maximum value. Therefore, when the input image data has the maximum grayscale level, the compensation image data can be set as the third value DE corresponding to the maximum grayscale level using the third gamma curve GCC. The third pixel P3 can be compensated more than the first pixel P1 and less than the second pixel P2.

Figure 5:
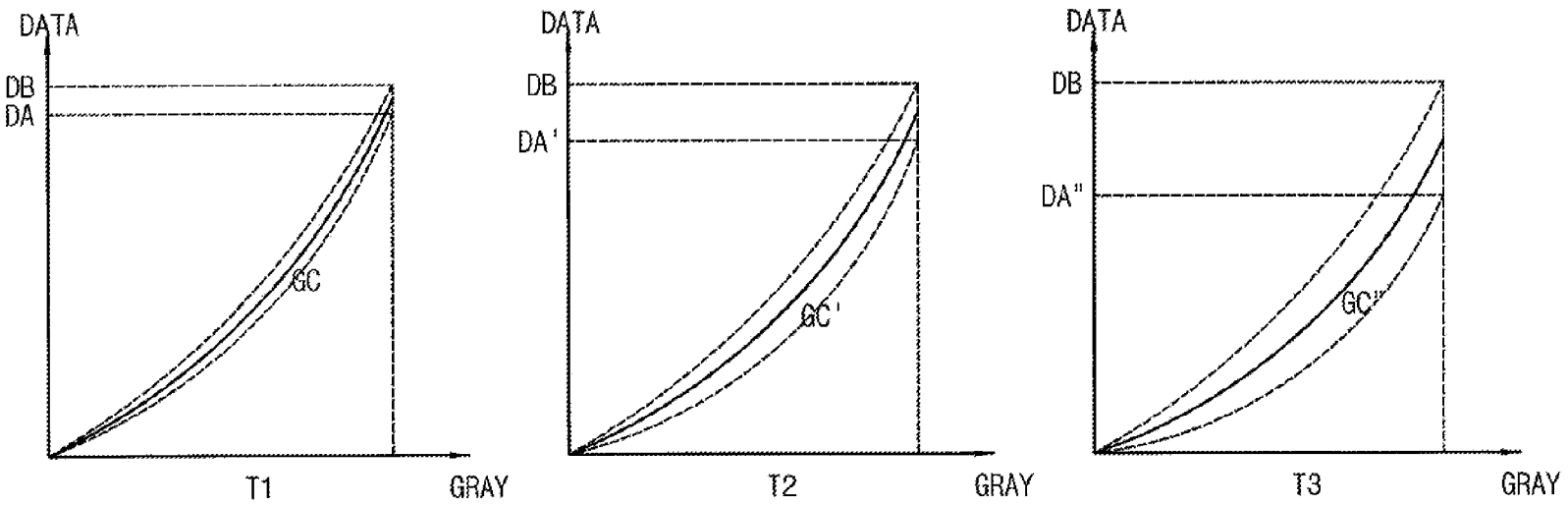
FIG. 5 is a graph for describing examples of changing gamma curves as driving time passes.

FIG. 5 is a graph for describing examples of changing gamma curves as driving time passes.

Referring to FIG. 5, compensation image data for a pixel is generated using one gamma curve GC in a first driving time T1. Therefore, when input image data has the maximum grayscale level, the compensation image data can be greater than or substantially equal to a first value DA that is the difference between a predetermined maximum value DB and a first compensation margin at the first driving time T1. Also, the compensation image data can be less than or substantially equal to the predetermined maximum value DB.

The compensation image data for the pixel can be generated using another gamma curve GC' in a second driving time T2 larger than the first driving time T1. A second compensation margin at the second driving time T2 can be greater than the first compensation margin at the first driving time T1. Thus, when the input image data has the maximum grayscale level, the compensation image data can be greater than or substantially equal to a second value DA' that is the difference between the predetermined maximum value DB and a second compensation margin at the second driving time T2. Also, the compensation image data can be less than or substantially equal to the predetermined maximum value DB.

The compensation image data for the pixel can be generated using the other gamma curve GC" in a third driving time T3 larger than the second driving time T2. A third compensation margin at the third driving time T3 can be greater than the second compensation margin at the second driving time T2. Therefore, when the input image data has the maximum grayscale level, the compensation image data can be greater than or substantially equal to a third value DA" that is the difference between the predetermined maximum value DB and a third compensation margin at the third driving time T3. Also, the compensation image data can be less than or substantially equal to the predetermined maximum value DB.

Figure 6:
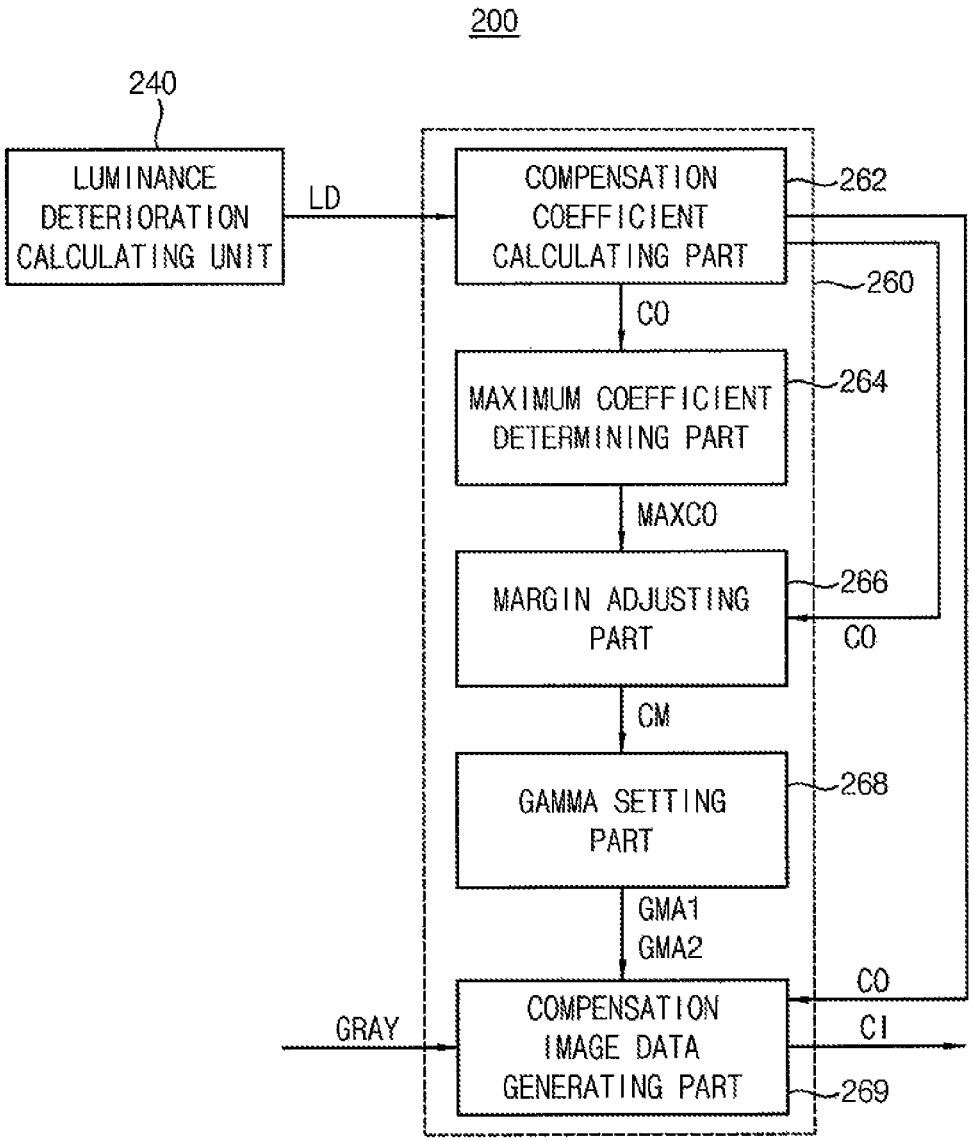
FIG. 6 is a block diagram illustrating a signal processor according to example embodiments.

FIG. 6 is a block diagram illustrating a signal processor according to example embodiments.

Referring to FIG. 6, a signal processor 200 includes a luminance deterioration calculating unit or luminance deterioration calculator 240 and a data compensation unit or data compensator 260.

The luminance deterioration calculating unit 240 can calculate luminance deterioration values LD of pixels. In example embodiments, the luminance deterioration values LD increase during a manufacturing process of the pixels. In example embodiments, the luminance deterioration values LD increase as degrees of deterioration of the pixels increase.

In example embodiments, the luminance deterioration calculating unit 240 calculates a sample luminance deterioration value of a sample pixel. Also, the luminance deterioration calculating unit 240 can calculate the luminance deterioration values LD by calculating a normal luminance deterioration value of a normal pixel based on the sample luminance deterioration value. In some embodiments, the luminance deterioration calculating unit 240 calculates the normal luminance deterioration value using an interpolation for the sample luminance deterioration value. For example, a first normal pixel has a first degree of deterioration between a second degree of deterioration of a first sample pixel and a second degree of deterioration of a second sample pixel. The first normal pixel can have a luminance deterioration value between a first sample luminance deterioration value of the first sample pixel and a second sample luminance deterioration value of the second sample pixel. In some embodiments, a luminance deterioration calculating unit 240 calculates a normal luminance deterioration value based on a linear interpolation algorithm. In some embodiments, a luminance deterioration calculating unit 240 calculates a normal luminance deterioration value based on a nonlinear interpolation algorithm.

The data compensation unit 260 can calculate compensation coefficients CO for each of the pixels based on the luminance deterioration values LD. Also, the data compensation unit 260 can adjust a compensation margin CM based on a maximum value MAXCO of the compensation coefficients CO. The data compensation unit 260 can generate middle image data. The middle image data is a maximum value that is dropped to a predetermined value from a predetermined maximum data value corresponding to the predetermined maximum luminance value of output light of the pixels based on the compensation margin CM. Therefore, in some embodiments, the middle image data does not have a value included in a range from the maximum value to the predetermined maximum data value.

The data compensation unit 260 can generate compensation image data CI by compensating input image data for each of the pixels based on the compensation coefficient CO and the compensation margin CM. For example, the data compensation unit 260 compensates the input image data by multiplying the compensation coefficient CO and the middle image data. Therefore, the compensation coefficients CO can increase as the luminance deterioration values LD increase. In some embodiments, the luminance deterioration values LD increase as the degrees of deterioration of the pixels increase. Therefore, the compensation coefficient CO can increase as the degrees of deterioration of the pixels increase.

In some embodiments, the data compensation unit 260 includes a compensation coefficient calculating part or compensation coefficient calculator 262, a maximum coefficient determining part or maximum coefficient determining portion 264, a margin adjusting part or margin adjuster 266, a gamma setting part or gamma setting portion 268, and a compensation image data generating part or compensation image data generator 269.

The compensation coefficient calculating part 262 can calculate compensation coefficients CO that offset the luminance deterioration values LD. In example embodiments, the compensation coefficient calculating part 262 estimates output luminance of light emitted by the pixels based on the degrees of deterioration. In example embodiments, the compensation coefficient calculating part 262 estimates the output luminance based on a LUT. Luminance that is changed based on the degree of deterioration can be estimated using simulations. The LUT can be generated using the estimated luminance. The compensation coefficient calculating part 262 can estimate the output luminance based on the LUT. In example embodiments, the compensation coefficient calculating part 262 calculates the compensation coefficients CO by using the above [Equation 1]. The luminance of the light emitted by the pixels can be compensated as an initial luminance using the calculated compensation coefficients.

The maximum coefficient determining part 264 can determine a maximum compensation coefficient MAXCO that is a maximum value of the compensation coefficients CO. The margin adjusting part 266 can adjust the compensation margin CM based on the maximum compensation coefficient MAXCO.

In some embodiments, the gamma setting part 268 determines a first gamma curve GMA1 such that the difference between the predetermined maximum luminance value and the luminance value corresponding to the maximum grayscale level in the first gamma curve is greater than the compensation margin CM. The number of the second gamma curves GMA2 can be substantially equal to the number of the pixels. For example, the gamma setting part 268 determines the second gamma curves GMA2 by scaling the first gamma curve GMA1 with the compensation coefficients CO corresponding to the pixels. The compensation image data generating part 269 can generate the compensation image data CI that corresponds to grayscale levels GRAY of the input image data using the second gamma curve GMA2.

In some embodiments, the gamma setting part 268 determines a first gamma curve GMA1 such that the difference between the predetermined maximum luminance value and the luminance value corresponding to the maximum grayscale level in the first gamma curve is greater than the compensation margin CM. The compensation image data generating part 269 can generate the middle image data corresponding to grayscale levels GRAY of the input image data by using the first gamma curve GMA1. Also, the compensation image data generating part 269 can generate the compensation image data CI by scaling the middle image data with the compensation coefficients CO.

In example embodiments, the gamma setting part 268 determines the first gamma curve GMA1 by scaling a standard gamma curve with a margin coefficient that is generated based on the compensation margin CM. Generally, the standard gamma setting is a relationship between the luminance and the grayscale level GRAY of an input image data having a gamma value as about 2.2. The standard gamma curve can be determined to emit the light having luminance corresponding to the standard gamma setting. Here, a gamma curve is a relationship between the middle image data and the grayscale levels GRAY. The gamma setting part 268 can determine the first gamma curve GMA1 by scaling the standard gamma curve with the margin coefficient. That is, the gamma setting part 268 can determine a first gamma curve GMA1 such that the difference between the predetermined maximum luminance value and the luminance value corresponding to the maximum grayscale level in the first gamma curve is greater than the compensation margin CM. For example, the margin coefficient is less than 1. The first gamma curve GMA1 can secure the compensation margin by scaling the standard gamma curve with the margin coefficient. Finally, the compensation image data generating part 269 can generate the middle image data corresponding to grayscale levels GRAY of the input image data using the first gamma curve.

The margin adjusting part 266 can adjust the compensation margin CM based on the maximum compensation coefficient MAXCO. Therefore, when the input image data is compensated, distortion caused by the output light being limited to the predetermined maximum luminance value can be prevented.

Although the example embodiments describe that the compensation coefficient is calculated by using above [Equation 1], the method of calculating the compensation coefficient is not limited thereto.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light-emitting diode (OLED) display comprising:

a display panel including a plurality of pixels;

a luminance deterioration calculator configured to receive input image data and calculate luminance deterioration values of the pixels;

a data compensator configured to i) calculate compensation coefficients for each of the pixels based at least in part on the luminance deterioration values, ii) adjust a compensation margin based at least in part on the maximum value of the compensation coefficients, and iii) generate compensation image data for each of the pixels based at least in part on the compensation coefficients and the compensation margin;

a panel driver configured to generate data signals based at least in part on the compensation image data and transmit the data signal to the pixels; and a timing controller configured to control the panel driver, wherein the pixels have a predetermined maximum luminance value, and wherein the data compensator includes:

a compensation coefficient calculator configured to calculate the compensation coefficients so as to offset the luminance deterioration values;

a maximum coefficient determining portion configured to determine a maximum compensation coefficient including the maximum value of the compensation coefficients;

a margin adjuster configured to adjust the compensation margin based at least in part on the maximum compensation coefficient;

a gamma setting portion configured to i) determine a first gamma curve such that the difference between the predetermined maximum luminance value and a luminance value corresponding to a maximum grayscale level in the first gamma curve is greater than the compensation margin and ii) scale the first gamma curve based at least in part on the compensation coefficients so as to determine a second gamma curve; and a compensation image data generator configured to generate the compensation image data corresponding to grayscale levels of the input image data based at least in part on the second gamma curve.

2. The display of claim 1, wherein the luminance deterioration calculator is further configured to increase the luminance deterioration values as degrees of deterioration of the pixels increase.

3. An organic light-emitting diode (OLED) display comprising:

a display panel including a plurality of pixels;

a luminance deterioration calculator configured to receive input image data and calculate luminance deterioration values of the pixels;

a data compensator configured to i) calculate compensation coefficients for each of the pixels based at least in part on the luminance deterioration values, ii) adjust a compensation margin based at least in part on the maximum value of the compensation coefficients, and iii) generate compensation image data for each of the pixels based at least in part on the compensation coefficients and the compensation margin;

a panel driver configured to generate data signals based at least in part on the compensation image data and transmit the data signal to the pixels; and a timing controller configured to control the panel driver, wherein the pixels have a predetermined maximum luminance value, and wherein the data compensation portion includes:

a compensation coefficient calculator configured to calculate the compensation coefficients so as to offset the luminance deterioration values;

a maximum coefficient determining portion configured to determine a maximum compensation coefficient including the maximum value of the compensation coefficients;

a margin adjuster configured to adjust the compensation margin based at least in part on the maximum compensation coefficient;

a gamma setting portion configured to determine a first gamma curve such that the difference between the predetermined maximum luminance value and a luminance value corresponding to a maximum grayscale level in the first gamma curve is greater than the compensation margin; and a compensation image data generator configured to i) generate a middle image data corresponding to grayscale levels of the input image data based at least in part on the first gamma curve and ii) scale the middle image data based at least in part on the compensation coefficients so as to generate the compensation image data.

4. The display of claim 3, wherein the compensation coefficient calculator is further configured to estimate an output luminance of light emitted by the pixels based at least in part on the degrees of deterioration.

5. The display of claim 4, wherein the compensation coefficient calculator is further configured to estimate the output luminance based at least in part on a look up table (LUT).

6. The display of claim 4, wherein the compensation coefficient calculator is further configured to calculate the compensation coefficients according to Equation 1 below:

$$SF1=Lo/L \qquad \text{Equation 1}$$

wherein SF1 is a compensation coefficient, Lo is an initial luminance value of each pixel, and L is an output luminance value of each pixel.

7. The display of claim 3, wherein the gamma setting portion is further configured to i) generate a margin coefficient based at least in part on the compensation margin and ii) scale a standard gamma curve based at least in part the margin coefficient.

8. The display of claim 3, further comprising an application processor (AP) including the margin adjuster.

9. The display of claim 8, wherein the timing controller includes the compensation coefficient calculator, the maximum coefficient determining portion, and the gamma setting portion.

10. The display of claim 1, wherein the pixels include a sample pixel and a normal pixel, and wherein the luminance deterioration calculator is further configured to i) calculate a sample luminance deterioration value of the sample pixel, ii) calculate a normal luminance deterioration value of the normal pixel based at least in part on the sample luminance deterioration value, and iii) calculate the luminance deterioration values based at least in part on the sample and normal luminance deterioration values.

11. The display of claim 10, wherein the luminance deterioration calculator is further configured to interpolate the sample luminance deterioration value so as to calculate the normal luminance deterioration value.

12. A signal processor for an organic light-emitting diode (OLED) display including a plurality of pixels, comprising:

a luminance deterioration calculator configured to calculate luminance deterioration values of the pixels, wherein the OLED display is configured to receive input image data; and a data compensator configured to i) calculate compensation coefficients for each of the pixels based at least in part on the luminance deterioration values, ii) adjust a compensation margin based at least in part on the maximum value of the compensation coefficients, and iii) generate compensation image data for each of the pixels based at least in part on the compensation coefficients and the compensation margin, wherein the pixels have a predetermined maximum luminance value, and wherein the data compensator includes:

a compensation coefficient calculator configured to calculate the compensation coefficients so as to offset the luminance deterioration values;

a maximum coefficient determining portion configured to determine a maximum compensation coefficient including the maximum value of the compensation coefficients;

a margin adjuster configured to adjust the compensation margin based at least in part on the maximum compensation coefficient;

a gamma setting portion configured to i) determine a first gamma curve such that the difference between the predetermined maximum luminance value and a luminance value corresponding to a maximum gray-scale level in the first gamma curve is greater than the compensation margin; and a compensation image data generator configured to i) generate a middle image data corresponding to gray-scale levels of the input image data based at least in part on the first gamma curve and ii) scale the middle image data with the compensation coefficient so as to generate the compensation image data.

13. The signal processor of claim 12, wherein the luminance deterioration calculator is further configured to increase the luminance deterioration values as degrees of deterioration of the pixels increase.

14. The signal processor of claim 12, wherein the compensation coefficient calculator is further configured to estimate an output luminance of light emitted by the pixels based at least in part on the degrees of deterioration.

15. The signal processor of claim 14, wherein the compensation coefficient calculator is further configured to estimate the output luminance based at least in part on a look up table (LUT).

16. The signal processor of claim 14, wherein the compensation coefficient calculator is further configured to calculate the compensation coefficients according to Equation 1 below:

$$SF1=Lo/L \qquad \text{Equation 1}$$

wherein, SF1 is a compensation coefficients, Lo is an initial luminance value of each pixel, and L is an output luminance value of each pixel.

17. The signal processor of claim 12, wherein the gamma setting portion is further configured to i) generate a margin coefficient based at least in part on the compensation margin and ii) scale a standard gamma curve based at least in part on the margin coefficient.

18. The signal processor of claim 12, wherein the pixels include a sample pixel and a normal pixel, and wherein the luminance deterioration calculator is further configured to i) calculate a sample luminance deterioration value of the sample pixel, ii) calculate a normal luminance deterioration value of the normal pixel based at least in part on the sample luminance deterioration value, and iii) calculate the luminance deterioration value based at least in part on the sample and normal luminance deterioration values.

* * * * *